US005423491A

United States Patent [19]

Johansson

[11] Patent Number: 5,423,491

[45] Date of Patent: Jun. 13, 1995

[54] TRANSPORTING AND/OR HANDLING AND/OR PROCESSING PLANT FOR SOIL, GRAVEL, SAND ETC.

[76] Inventor: Jan E. Johansson, Husmansgången 1, S-240 14 Veberöd, Sweden

[21] Appl. No.: 29,568

[22] Filed: Mar. 11, 1993

[30] Foreign Application Priority Data

Mar. 11, 1992 [SE] Sweden ..... 9200746

[51] Int. Cl.[6] ..... B02C 21/02; B02C 25/00

[52] U.S. Cl. ..... 241/79; 241/101.7; 366/66; 366/345

[58] Field of Search ..... 241/79, 101.7; 366/66, 366/109, 154, 186, 345, 346

[56] References Cited

U.S. PATENT DOCUMENTS 2,580,854 1/1952 Sherman .
3,096,212 7/1963 Rosenleaf .
4,125,332 11/1973 Schmednecht .
4,164,597 8/1979 Smith .
4,591,275 5/1986 Garthus .
4,981,204 1/1989 Smith .

FOREIGN PATENT DOCUMENTS 0450738 10/1991 European Pat. Off. .
1575402 1/1969 France .
2240035 2/1974 Germany .
221642 9/1924 United Kingdom .

OTHER PUBLICATIONS

Tambov, Abstract AN 87-234001 and SU-A-1 281 292, Week 8733, *Derwent Publications Ltd.,* (1987).

*Primary Examiner*—Timothy V. Eley
*Attorney, Agent, or Firm*—Foley & Lardner

[57] ABSTRACT

One type of plant for transporting, handling and processing materials such as sand, gravel, crushed aggregate, soil, peat and recoverable excavated material. A screening plant for particularly screening of said materials comprises at least one feed station onto or into which material to be screened is brought or fed for discharge onto a screen conveyor which feeds the material to a further station such as a screening device wherein screening is carried out. In order to permit mixing principally everywhere mixing is necessary or convenient, the screening plant is also provided with at least one mixing device positionable in at least one operating position and an inoperative or rest position, when in operating position, the mixing device permits mixing of two or more of the above materials which have been supplied to the screening plant when these materials pass the mixing device.

15 Claims, 5 Drawing Sheets

TRANSPORTING AND/OR HANDLING AND/OR PROCESSING PLANT FOR SOIL, GRAVEL, SAND ETC.

BACKGROUND OF THE INVENTION

The present invention relates to a plant for handling, such as by transporting, crushing, screening or processing particulate materials such as sand, gravel, crushed aggregate, soil, peat or recoverable excavated material. Preferably the invention is used with a screening plant or a part thereof. The screening plant should be of the type which includes at least one feed station, onto or into which material to be transported, crushed, screened, handled or processed in other ways is brought or fed for discharge onto a conveyor which feeds the material to a location for storing or to a device for further transport or for crushing, screening, handling or processing.

Materials to be used in the superstructure, such as the subbase, base or bearing course and surfacing for streets and roads, air fields or railroads, must meet or comply with certain requirements. Streets and roads with a sub-base however, can, after a certain time, show extensive tracking in the roadway. Tracking, which might cause aquaplaning on surfaced streets and roads, depends to a large degree on whether the material in the subbase has settled. The reason for the settling often seems to be the too small variations in size of the particles or grains in the material for the subbase. A larger particle size distribution, i.e. larger variations in the particle or grain size, and optimal carrying capacity of the included stone material is therefore aimed at. However, this has substantially limited the material which can be used for subbases for streets and roads. Large areas of the country are short of acceptable material. The building of new roads therefore requires longer transports of material complying with the requirements, especially within the areas short of acceptable material, whereby the costs for the road building are substantially increased.

To be able to increase the exploitation of existing resources, one has started to mix various materials, where one or more of the materials normally could not be used as superstructure materials, but the mixture has the required properties. This means a saving of material and permits use of otherwise unusable material. In certain cases, only otherwise unusable material is being used. Alternative materials such as crushed rock, rock flour, lime, cement, gypsum, hardcore, ore, and ashes can be used, resulting in an additional saving of the resources and an environmental protective factor.

Existing mixers or mixing plants for the abovementioned mixing of superstructure materials are large and complex separate units which are expensive and can not be found wherever mixing is required or suitable to carry out.

SUMMARY OF THE INVENTION

The object of the present invention is thus to eliminate this problem and present a solution which permits mixing principally everywhere mixing is required or convenient.

For this purpose, according to the invention, the plant defined above, preferably a screening plant or part thereof, is also provided with at least one mixing device which is settable or positionable in at least one operating position and a rest position. In the operating position, the mixing device permits mixing of two or more particulate materials when these materials pass the mixing device.

According to the invention, the mixing device is reduced to a relatively small, less complex unit, which by simple means is mounted preferably on one of the more common screening plants but also on any other plant. By simple means the mixing device can be set or brought into one or more various operating positions for mixing and can also be set and locked in a rest position when the screening plant or part thereof is used for screening or the plant is used for purposes other than screening, or when mixing is not wanted when screening or any other handling or processing occurs. Owing to the invention it is also possible, immediately after screening, to mix a screened material with another material without time-consuming and expensive transports of material between the screening and mixing operations.

BRIEF DESCRIPTION OF THE DRAWINGS

The invention will be further described below with reference to the accompanying drawings, wherein.

DESCRIPTION OF THE PREFERRED EMBODIMENTS

Figure 1:
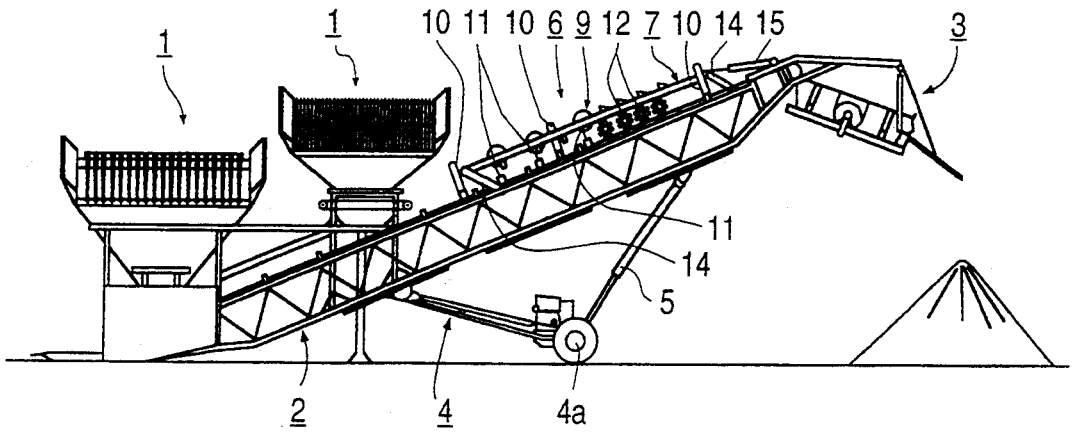
FIG. 1 is a schematic side view of an embodiment of a screening plant according to the invention, provided with a mixing device.

The screening plants illustrated in FIGS. 1–6 are intended for screening materials such as sand, gravel, crushed aggregate, soil, peat and recoverable excavated material. The screening plants are of the type comprising at least one feed station 1 onto or into which material to be screened is brought or fed for discharge onto a screen conveyor 2. The material brought to the feed station has already been subjected to one or more crushing, screening and transporting steps and/or been subjected to other handling and/or processing. The screen conveyor 2 feeds the material to a further station such as a screening device, here a swing or plate screen 3, in which screening occurs. Instead of a plate screen 3, a rotatable screen drum or other prior art type of screening device may be used. From the plate screen 3, the fractions of material, i.e. the various screened materials, may then be fed further through a tail conveyor (not shown) and one or more side conveyors (not shown) for storing on the location, for further screening, for mixing with one or more other materials, for another handling and/or processing or for further transport. The screening plant can be mobile as in FIGS. 1–6. Thus it can be provided with a wheel undercarriage 4 fastened to the screen conveyor 2 and having wheels 4*a*. Between the wheels and the screen conveyor any type of device 5, preferably hydraulic, can be used for setting the screen conveyor in a suitable feed position. The screening plant can also be stationary and comprise a plurality of screening units or screening parts of the above structure including components for crushing in the feed stations. Alternatively, separate units can be used such that screening, crushing, transport and/or another handling and/or processing are carried out in several steps in several locations. The parts of the screening plant are of conventional prior art construction and therefore not further described here.

To permit mixing of one or more of the normally screened materials with each other and/or with suitable alternative materials such as lime, cement, or gypsum, the screening plant according to the invention illustrated in the drawings further comprises a mixing device 6 which can be set in at least one operating position and a rest position when in an operating position, the mixing device permits mixing of two or more materials which have been supplied to the screening plant when these materials pass the mixing device. Thus, mixing can be carried out quickly and simply by using one of the screening plants located on substantially all gravel pits. No transportation of large mixing machines to mixing locations is required. Larger screening plants having several screening units or screening parts may have one or more mixing devices 6 as required or desired.

Figure 2:
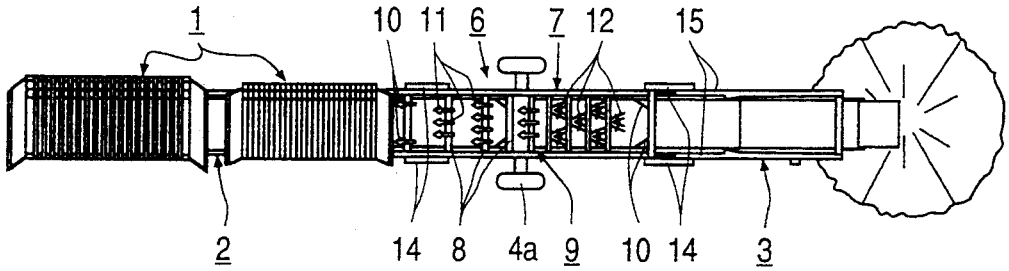
FIG. 2 is a plan view of the screening plant with mixing device according to FIG. 1.

In a preferred embodiment, the mixing device 6 according to the invention is fixedly or releasably mounted on the screen conveyer 2 of the screening plant. The materials to be mixed are brought or fed into the feed station 1 in certain amounts in proportion to the desired mixture of said materials. Alternatively, the feed station 1 may, with the illustrated shape as a type of charge funnel or feeding hopper, have different compartments for the various materials, whereby discharge of material from the various compartments is controlled proportionally. This control as well as supervision of the level of the materials in the various compartments is carried out preferably electronically and preferably so that mixing is automatically interrupted before there is a shortage of one or more of the materials to be mixed. Other alternatives are that the screening plant includes more than one feed station, as in FIGS. 1 and 2 showing two feed stations 1 of the abovementioned hopper type. It is thereby possible to feed material to be mixed directly from one or more other screening plants or from one or more other parts of a larger screening plant to the feed stations 1 of the screening plant or the part thereof provided with the mixing device 6. Then, the screen conveyor 2 feeds the materials from the feed station(s) to the mixing device 6 for mixing while the materials pass the mixing device before reaching the plate screen 3.

The mixing device 6 comprises, in a preferred embodiment, a frame 7 which is disposed above the screen conveyor 2. On the frame 7 or, as in the drawings, on shafts 8 within said frame, mixing means 9 are operatively or inoperatively provided in accordance with the need and the materials to be mixed at the location. This means that the mixing means 9 may be immovably mounted or they may be movable. They can be rotatable or movable laterally on or with the shafts 8 and thereby be driven by means of motors (not shown) or by the materials passing the mixing device. The mixing means 9 are, particularly if they are of various types, mounted after each other in the longitudinal direction of the screen conveyor 2, but mixing means of various types may of course also be mounted side by side on the same shaft 8. Similarly, mixing means 9 of the same type can be located after each other in the longitudinal direction of the screen conveyor 2 and/or beside each other, according to the requirements and the materials to be mixed. The frame 7 can be immovably mounted on the screen conveyor 2 or resiliently provided thereon.

Figure 3:
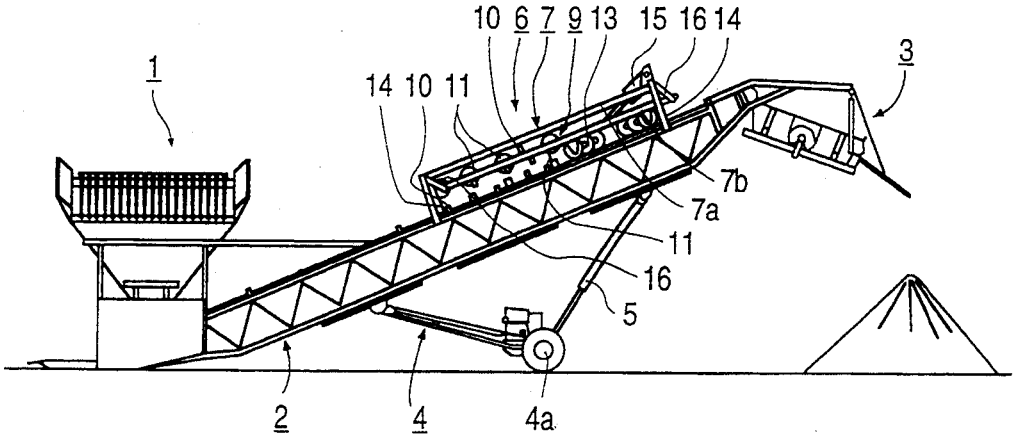
FIG. 3 is a schematic side view of a somewhat different embodiment of a screening plant according to the invention, comprising a second, alternatively constructed mixing device.
Figure 4:
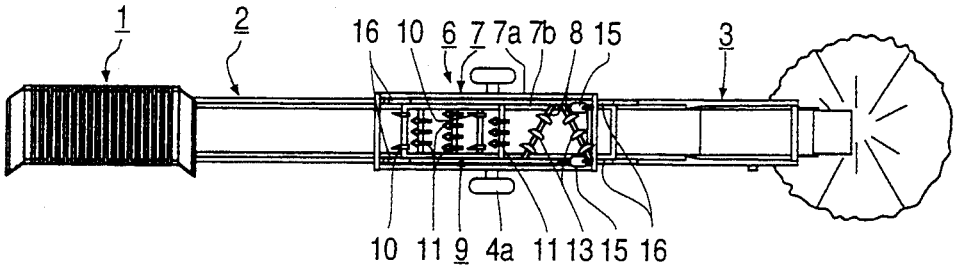
FIG. 4 is a plan view of the screening plant with mixing device of FIG. 3.
Figure 5:
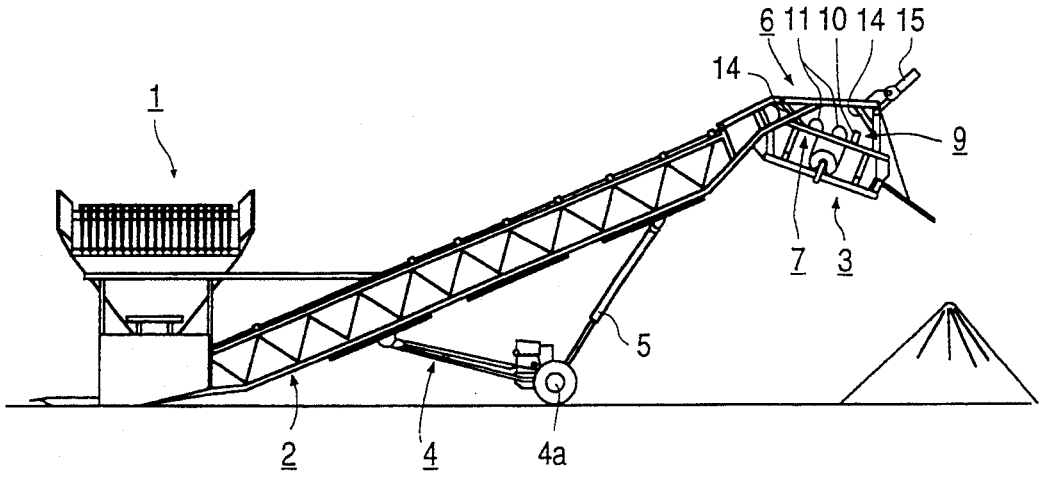
FIG. 5 is a schematic side view of the screening plant of FIG. 3, but with a third embodiment of the mixing device.
Figure 6:
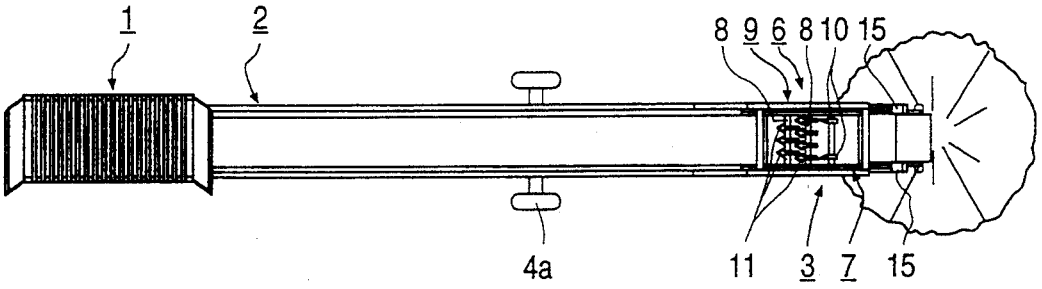
FIG. 6 is a plan view of the screening plant with mixing device according to FIG. 5.

If the frame 7 is immovable, then the mixing means 9, which preferably are adjustable in any suitable way on the shafts 8, can be set in different operating positions in which the materials being mixed are affected in various degrees depending on the material in question. The mixing means 9 should also be settable in an inoperative or rest position when mixing is not wanted. The shafts 8 ought to be resiliently or yieldingly mounted on the frame. Preferably, each mixing means can be set separately. Alternatively all mixing means on each shaft 8 can be set. The mixing means 9 can hereby give way or deflect from a set operating position for mixing towards an inoperative position permitting no or substantially no mixing. This inoperative position is not necessarily corresponding with the inoperative or rest position in which the mixing means 9 are set when mixing is not wanted. Deflection occurs if the pressure on the mixing means for some reason should become too large, e.g. because of large stones, whereby damage to the mixing means is prevented. As indicated above, the mixing means 9 can have any suitable shape and position for its function and mixing means of different types can be mixed if this seems to be required for an optimal result. They can have the shape of a plough 10, they can be designed as resilient teeth 11 as in a harrow and be provided with adjustable and/or replaceable points or cutting shares, they can be rotatable either by means of a motor or due to the influence of the materials to be mixed, and designed as knife crosses 12 suspended in springs (FIGS. 1 and 2) or as discs (FIGS. 3 and 4). The mixing means 9 are also entirely or partially made of any low-friction plastic material, such as high-molecular polyethylene, or of rubber or any other suitable material. The mixing means 9 may also be vertically displaceable or replaceable to compensate for eventual wear thereof.

If the frame 7 is resiliently or yieldingly mounted on the screen conveyor 2 then the mixing means 9 need not be resilient too. Of course, it is possible for both the frame mounting and the mixing means to be resilient. If the mixing means 9 are fixed, they are still designed as described above.

A resilient or yielding frame 7 is shown in the drawings in three different embodiments.

In the first embodiment (FIGS. 1 and 2), the frame 7 with the mixing means 9 is preferably rectangular in shape and 4 m long, is movably mounted on the screen conveyor 2 through arms 14. There are two arms 14 on each side of the screen conveyor. The arms 14 are pivotally attached to the frame at its corners and to the screen conveyor. The frame 7 is held in operating position for mixing by means of at least one hydraulic or spring device. These are preferably piston/cylinder devices 15 which preferably also are adjustable in an appropriate way such that a certain amount of force can vary depending on the materials to be mixed, must be overcome. This means that a larger force must be applied onto any mixing means 9 by e.g. a stone, before the frame is moved from the operating position according to FIGS. 1 and 2 with the arms 14 directed obliquely upwards/backwards from the screen conveyor 2 (against the feed direction of the materials to be mixed) towards an inoperative position located farther away from said screen conveyor and in which no or substantially no mixing is carried out, with the arms directed substantially perpendicular to the screen conveyor. When the force applied onto the mixing means 9 ceases, the frame returns to its operating position by means of the piston/cylinder devices 15. The frame 7 can preferably be locked in the inoperative or rest position by a suitable construction of the piston/cylinder devices 15, so that demounting of the mixing device 6 is not required when the screening plant shall be used for screening material or mixing for some reason is not wanted. Locking of the frame 7 in the rest position can also be carried out manually.

In the second embodiment (FIGS. 3 and 4), which is somewhat more complex, the frame consists of a rectangular upper frame member *7a* and a rectangular lower frame member *7b*. The upper frame member *7a* is through arms 14, two on each side of the screen conveyor 2, immovably mounted on said screen conveyor. The lower frame member *7b* is through arms 16 which are pivotally attached to said lower frame member at the corners thereof and to the upper frame member *7a*, pivotally suspended in said upper frame member. The mixing means 9 finally are, as in the first embodiment, preferably immovably, i.e. not resiliently or yieldingly mounted on the lower frame member *7b*. The frame member is movable or deflectable from the operative position permitting mixing according to FIGS. 3 and 4 obliquely upwards and forward in the feed direction of the materials to be mixed, towards an inoperative position wherein the lower frame member *7b* is located near the upper frame member *7a* so that no or substantially no mixing is permitted. The lower frame member *7b* is held in the operative position by means of at least one hydraulic or spring device, here piston/cylinder devices 15 which also permit said deflection of the lower frame member *7b* when a certain force, which can be adjusted depending on the mixed materials and by means of which the lower frame member is held in operative position by said piston/cylinder devices, is exceeded by the pressure of the materials to be mixed on one or more of the mixing means 9. When the pressure on the mixing means 9 ceases, the lower frame member *7b* returns to its operating position by means of the piston/cylinder devices 15. The piston/cylinder devices 15 are preferably also designed such that they permit locking of the lower frame member *7b* in the inoperative or rest position thereof, whereby the mixing device 6 does not hang in the way during screening. Locking can also be carried out manually with any type of retaining or hook means which are brought to engage and hold the frame members *7a*, *7b* together with the lower frame member *7b* close under the upper frame member *7a*.

It is of course also possible to provide the lower frame member *7b* resiliently or yieldingly so that it is held in operative position by its own weight and that it is only that weight which must be exceeded for deflecting said lower frame member. However, hydraulic or spring devices can be provided also here, but not for holding the lower frame member *7b* in operating position, only to counteract displacement of said frame member from said operating position and facilitate its return thereto.

A vibrating device (not shown) can be provided for vibrating the mixing device 6 if desired and thus facilitate and improve the mixing procedure.

It should be noticed that when mixing is to be carried out, a cloth or plate of teflon or another material with low friction is preferably placed over the screen plate (preferably uppermost screen plate if many) in the plate screen 3, so that the mixed materials do not fall through said screen plate during passage thereof; thus obviating the risk that the materials just mixed are screened into various fractions. This problem can be solved in other ways and in certain cases it is desired that screening occurs also after mixing.

In the third embodiment (FIGS. 5 and 6), the mixing device 6 is instead fixedly or releaseably mounted on the plate screen 3 to the screening plant. The mixing device 6 comprises also here a preferably rectangular frame 7 which through arms 14 is movably located above the plate screen 3 and which is provided with operatively or inoperatively mounted mixing means 9. Here, there are also provided piston/cylinder devices 15 to hold the frame 7 in operating position. These piston/cylinder devices 15 permit displacement or deflection of the frame 7 when any mixing means 9 is affected by the material which is mixed with a larger force than the force by which said piston/cylinder devices keep the frame 7 in operating position, but as soon as this force has ceased, said devices 15 return said frame 7 and thus, the mixing device 6, to the operating position. The piston/cylinder devices 15 also permit locking of the frame 7 (mixing device 6) in an inoperative or rest position. The mixing means 9 can also, as previously stated, be preferably displaceable for setting thereof in different operating positions for mixing in accordance with the materials to be mixed or in an inoperative position permitting no or substantially no mixing, such that said mixing means are not in the way when screening is carried out or when mixing with certain mixing means is not desired. This is important especially if the frame 7 is immovable and thus, not retainable in an inoperative position or rest position. The mixing means 9 can be mounted on the frame 7 such that they are not resilient or do not yield, particularly if the frame is resiliently or yieldingly mounted on the plate screen 3. They can also be resiliently or yieldingly mounted on the frame. If the frame 7, as the mixing devices 6 on the screen conveyor 2, is not resiliently or yieldingly mounted on the plate screen 3, then the mixing means 9, except for being adjustable for setting in an inoperative position when mixing is not desired, should be resilient or yielding. The mixing means 9 are also otherwise constructed, located and designed as the mixing means described above.

The plate screen 3, which before mixing of the materials to be mixed is provided with a cloth or plate over the screen plate, is preferably also provided with a driving device for vibrating said plate screen and thus, the materials passing the mixing device on said plate screen. The mixing device can also here comprise a driving device of its own for vibration of said mixing device independent of the plate screen.

Figure 7:
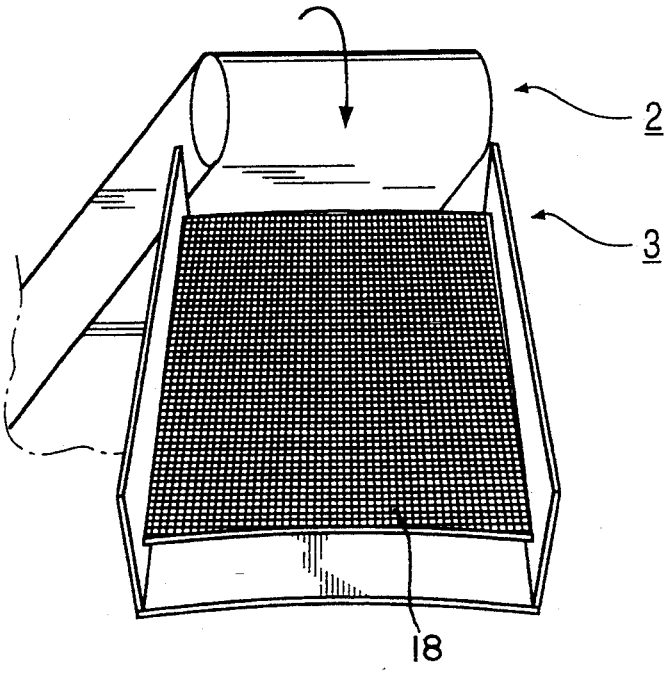
FIG. 7 is a schematic perspective view of the swing or plate screen of the screening plants of FIGS. 1–6.
Figure 8:
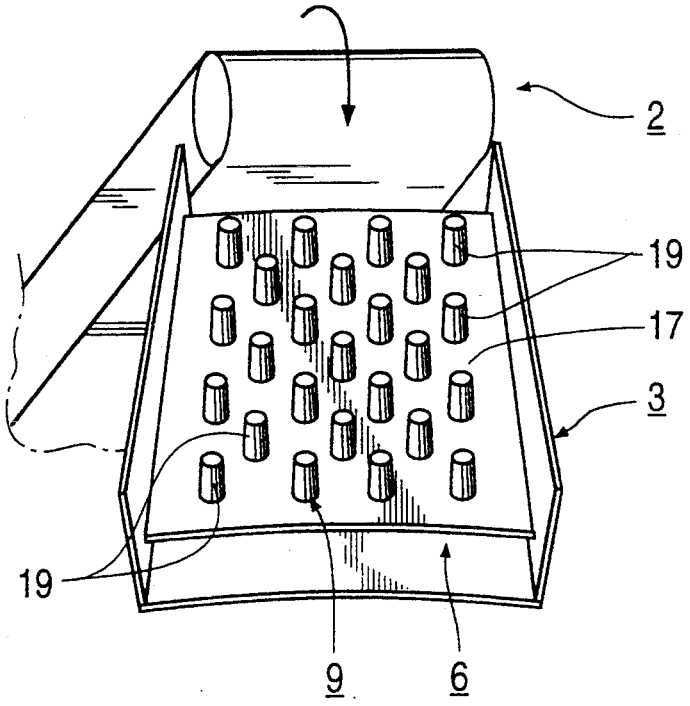
FIG. 8 is a schematic perspective view similar to FIG. 7, but here the plate screen is provided with a fourth embodiment of the mixing device.

Instead of the mixing devices described above, such a mixing device 6 may alternatively consist of a sheet 17 with mixing means 9, whereby said sheet is placed on the plate screen 3 (see FIG. 8). Hereby, the need is eliminated for a separate cloth or plate over the screen plate 18 (FIG. 7) when screening during mixing is not wanted. The sheet 17 is preferably suspended in the plate screen 3 above the screen plate 18 thereto and, when used, lowerable onto said screen plate. However, the sheet 17 may also, when not in use, be brought into compartments (not shown) on the sides of the screening plant or on top of the plate screen 3. The mixing means 9 are here preferably shaped as teeth (19) and positioned to provide optimal mixing; preferably in a plurality of rows so that the spaces between said mixing means in a row extending perpendicular to the direction of movement of the materials to be mixed are covered by the mixing means in the nearest preceding and/or nearest subsequent row of mixing means. Hereby, none of the materials to be mixed can pass the mixing device 6 without being affected by any mixing means 9. Also in this embodiment it is appropiate if the plate screen 3, and thus the mixing device 6, is vibrated.

Figure 9:
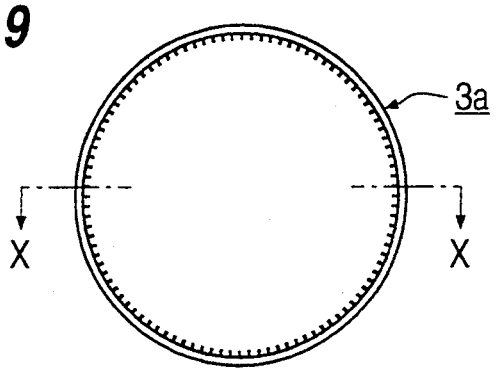
FIG. 9 is an end view of a screen drum for use in a screening plant.
Figure 10:
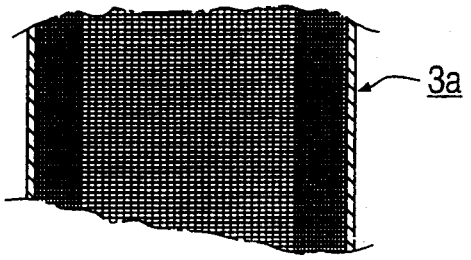
FIG. 10 is a longitudinal section along the line X—X in FIG. 9 through a portion of the screen drum.
Figure 11:
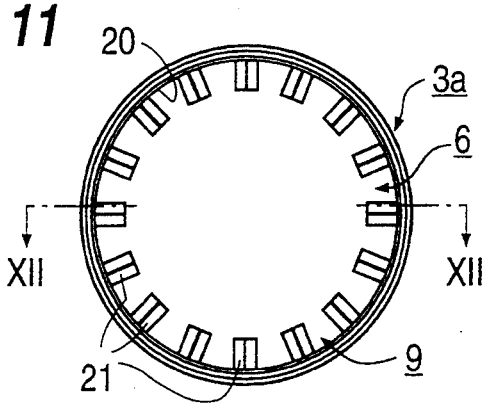
FIG. 11 is an end view of the screen drum of FIG. 9 provided with a fifth embodiment of the mixing device.
Figure 12:
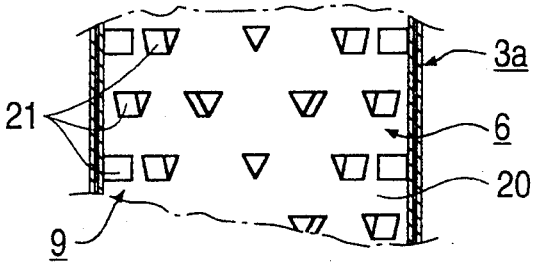
FIG. 12 is a longitudinal section along the line XII—XII in FIG. 11 through the screen drum portion of FIG. 10 provided with said fifth mixing device embodiment.

If a rotatable screen drum or another screening device is used instead of a plate screen, the mixing device may, except for on the screen conveyor, also be located inside the screen drum while rotating said drum during mixing. Alternatively, the mixing device can be movably or immovably mounted in any suitable way on or in said screening device. A preferred embodiment of the mixing device 6 in a screen drum 3*a* according to FIGS. 9 and 10 is a cylindrical member 20 (FIGS. 11 and 12) having radially inwardly directed mixing means 9 of a suitable type, preferably shaped as teeth as in the sheet described above or plough-like mixing means 21. The cylindrical member 20 is brought into the screen drum 3*a* and releaseably fastened therein, so that it can rotate with the drum. The cylindrical mixing device 6 must be able to cover the entire screen drum 3*a* from the inside or eventually be completed with other cylindrical members (not shown) so that the materials to be mixed can not pass out through the screen wall. The cylindrical mixing device 6 and eventually other cylindrical elements or cylinder segments are preferably placed, when not in use, on or at the outside of the screening device or other parts of the screening plant. Otherwise, the mixing device 6 is designed as above and the same measures are taken before mixing commences.

It is obvious to a skilled person that beyond what is stated above, the present invention can be amended and modified within the scope of the following claims without departing from the idea and purpose of the invention. Thus, the mixing device can be mounted on other locations on the screening plant than those described above; it can be extendable in length as well as in width to fit screen conveyors or screening devices of various sizes and it can be designed such that by simple means it is easy to release from the screening plant, that part or those parts thereof or from any other plant on which it is mounted; the mixing means can be designed and arranged in other ways than as is shown in the drawings; the mixing means can be movably or immovably mounted on the frame in any suitable manner; they can be adjustable in any appropriate manner; they can be made resilient or yielding in any suitable way and their number may vary in accordance with the need and the materials to be mixed.

It is also obvious to a skilled person that mixing devices of the above types can be used at other types of plants besides screening plants for transport, handling or processing of materials such as sand, gravel, crushed aggregate, soil, peat and recoverable excavated material. It is also obvious from the above that many mixing devices can be provided for mixing before storing or transport and before any other handling and/or processing is carried out of the materials to be mixed, and also for mixing after the materials have been handled and/or processed in any desired way and before as well as after transport and/or handling and/or processing.

I claim:

1. A plant for accomplishing at least one of transporting, crushing and screening materials such as sand, gravel, crushed aggregate, soil, peat, and recoverable excavated material, said plant comprising:

at least one feed station receiving and discharging the materials;

a band conveyor feeding the materials discharged from the at least on feed station to a device for at least one of crushing and screening;

at least one mixing device, mixing at least two of the materials, having a frame yieldingly mounted on the band conveyor; and mixing means mounted on the frame;

wherein the frame pivots and deflects from an operating position to an inoperative position when a certain force is applied on the mixing means by materials to be mixed.

2. A plant according to claim 1, wherein the frame is held in the operating position by at least one adjustable device which permits deflection of the frame when the certain force is applied on the mixing means by the materials to be mixed, and which permits locking of the frame in the inoperative position.

3. A plant according to claim 1, wherein the frame comprises an upper and a lower frame member, the upper frame member being immovably mounted on the band conveyor, the lower frame member being pivotally suspended in the upper frame member such that the lower frame member pivots and deflects from the operating position toward the inoperative position when the certain force is applied on the mixing means by the materials to be mixed, and the mixing means are non-yieldingly mounted on the lower frame member.

4. A plant according to claim 3, wherein the lower frame member with the mixing means is held in the operating position by at least one adjustable device which permits deflection of the lower frame member when the certain force is applied on the mixing means by the materials to be mixed, and which permits locking of the lower frame member in the inoperative position.

5. A plant according to claim 1, wherein said plant is a screening plant; wherein the device for at least one of crushing or screening is a screening device; and wherein the at least one mixing device is mounted on the screening device.

6. A plant according to claim 5, wherein the screening device is a plate screen and the at least one mixing device is mounted above the plate screen.

7. A plant according to claim 6, wherein the mixing means are adjustable for setting thereof in different operating positions and in an inoperative position.

8. A plant according to claim 6, wherein the mixing means are yieldingly mounted on the frame for pivoting and deflecting from an operating position toward an inoperative position when the certain, predetermined force is applied thereon by the materials to be mixed.

9. A plant according to claim 6, wherein the frame is yieldingly mounted on the plate screen pivoting and deflecting from an operating position towards an inoperative position when the certain force is applied on the mixing means by the materials to be mixed, and the mixing means are non-yieldingly mounted on the frame.

10. A plant according to claim 5, wherein the screening device is a plate screen and the mixing device comprises a sheet with mixing means, the sheet being settable on top of a screen plate in the plate screen.

11. A plant according to claim 5, wherein the screening device is provided with a driving means for placing the screening device and the materials to be mixed in motion.

12. A plant according to claim 5, wherein the screening device is a screen drum and the at least one mixing device comprises at least one cylindrical member mounted inside the screen drum with radially inwardly directed mixing means.

13. A device for mixing and conveying particulate material comprising:

a) at least one feed station receiving the particulate material;

b) a conveyor positioned adjacent to and receiving the particulate material from the feed station and conveying the particulate material to a further station; and c) a mixer, on the conveyor intermediate the feed station and the further station, having an operating mixing position and an inoperative position, whereby the particulate material is mixed as it moves on the conveyor to the further station;

wherein the mixer comprises a frame yieldably mounted on the conveyer, the frame deflecting from the operating mixing position toward the inoperative position when a force is applied by the particulate material being mixed.

14. The device of claim 13, wherein the frame is held in the operating position by a hydraulic device, the hydraulic device being lockable in the inoperative position.

15. The device of claim 13, wherein the frame is held in the operating position by a spring, the spring being lockable in the inoperative position.

* * * * *